US005926674A

United States Patent [19]

Tabb et al.

[11] Patent Number: 5,926,674

[45] Date of Patent: Jul. 20, 1999

[54] REVERSE POLARITY SPLIT RECHARGE IN RECHARGE-EXPOSE-AND-DEVELOP IMAGE ON IMAGING PRINTING

[75] Inventors: Charles H. Tabb; Mark S. Jackson, both of Rochester; John F. Obrien; Dan A. Hays, both of Fairport, all of N.Y.

[73] Assignee: Xerox Corporation, Stamford, Conn.

[21] Appl. No.: 09/004,672

[22] Filed: Jan. 8, 1998

[51] Int. Cl.[6] ..... G03G 15/01

[52] U.S. Cl. ..... 399/231; 399/40

[58] Field of Search ..... 399/186, 39–40, 399/223, 228, 231–232, 298

[56] References Cited

U.S. PATENT DOCUMENTS

| | | | |
|---|---|---|---|
| 5,258,820 | 11/1993 | Tabb | 355/328 |
| 5,351,113 | 9/1994 | Pietrowski et al. | 355/273 |
| 5,537,198 | 7/1996 | Jackson | 355/326 |
| 5,579,100 | 11/1996 | Yu et al. | 355/326 |
| 5,581,330 | 12/1996 | Pietrowski et al. | 355/221 |
| 5,600,430 | 2/1997 | Folkins et al. | 399/171 |
| 5,794,106 | 8/1998 | Folkins | 399/231 |

*Primary Examiner*—William Royer
*Assistant Examiner*—Quana Grainger
*Attorney, Agent, or Firm*—John M. Kelly

[57] ABSTRACT

A Recharge-Expose-and-Develop Image on Image color electrophotographic printing system in which the photoreceptor is recharged between development of one color of toner image and the subsequent exposure for a second color latent image by first being sprayed with opposite sign ions to reduce the photoreceptor potential and then being charged with correct sign ions to recharge the photoreceptor to a desired potential.

7 Claims, 2 Drawing Sheets

REVERSE POLARITY SPLIT RECHARGE IN RECHARGE-EXPOSE-AND-DEVELOP IMAGE ON IMAGING PRINTING

FIELD OF THE INVENTION

This invention relates to electrophotographic color printers that use the Recharge, Expose, and Develop Image on Image processing. In particular, this invention relates to photoreceptor recharging.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD 101 process (Recharge, Expose, and Develop, Image On Image), a charged photoreceptive surface is exposed to a light image which represents a first color, say black. The resulting electrostatic latent image is then developed with black toner particles to produce a black toner image. The photoreceptor is then recharged, exposed, and developed for a second color, say yellow, then for a third color, say magenta, and finally for a fourth color, say cyan. The various color toner particles are placed in superimposed registration such that a desired composite color image results. That composite color image is then transferred and fused onto a substrate.

The REaD IOI process can be implemented in various ways. For example, in a single pass printer wherein the composite final image is produced in a single pass of the photoreceptor through the machine. A second implementation is in a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

Whatever the implementation, the photoreceptor is initially charged for the first exposure and then recharged for subsequent exposures. One important consideration following recharge is the voltage between previously developed toner layers and the photoreceptor. If the voltage is too large undesirable interactions occur between toner layers, resulting in poor color separations.

However, in REaD IOI systems that use split recharging it has been found that print quality defects that are associated with low- or wrong-sign toner in the developed toner can occur. Two of these defects are under color splatter ("UCS"), in which development of a second color causes particles of the first color to jump into background areas, and cross-contamination, in which dislodged particles of the first color are pulled into the development housing of another color, and subsequently redeveloped. Both of these defects tend to become more objectionable when the REaD IOI system is optimized for more robust rendering of small lines and/or dots. Using an AC scorotron rather than a DC scorotron charging device at the second stage of split recharge generally helps improve latitude against these defects, but they might not be entirely eliminated.

An alternative to split recharge is direct AC recharging in which the photoreceptor is first erased (using flood exposure) after each color development step and then the photoreceptor is recharged using a high-slope AC device. The AC device, although predominately delivering ions of the charging polarity, will produce an increasing level of opposite-polarity ions as the target voltage is approached. Those ions serve to reduce toner voltage, but are not so numerous as to produce excessive UCS and cross-contamination defects. However this approach depends on the use of photoreceptor erasure to assure upwards charging in all photoreceptor areas. Because the erase device requires physical space and because it may require a minimum time before recharge (to enable the photoreceptor to recover from the effects of the high light levels employed) this may not be practical, particularly in single-pass REaD IOI architectures.

Therefore a recharge approach which controls toner layer voltage without creating an objectionable degree of cross-contamination or under color splatter, and which does not require the use of photoreceptor erasure would be beneficial.

SUMMARY OF THE INVENTION

This invention provides for methods and apparatus that are useful in REaD IOI recharging. The principles of the present invention provide for spraying a photoreceptor having a developed toner layer(s) with opposite charged ions to reduce the potentials of the photoreceptor and its toner layer(s), and then recharging the photoreceptor and toner layer(s) to the desired potential using correct charged ions If the photoreceptor is to have a negative charge during exposure, between the development of one toner layer and the exposure of a subsequent latent image, the photoreceptor is sprayed with positive ions. The photoreceptor is then recharged to the desired potential using negative ions. Alternatively, if the photoreceptor is to have a positive charge during exposure, between the development of one toner layer and the exposure of a subsequent latent image, the photoreceptor is sprayed with negative ions and then recharged to the desired potential using positive ions.

BRIEF DESCRIPTION OF THE DRAWINGS

Other aspects of the present invention will become apparent as the following description proceeds and upon reference to.

DETAILED DESCRIPTION OF A PREFERRED EMBODIMENT OF THE INVENTION

Figure 1:
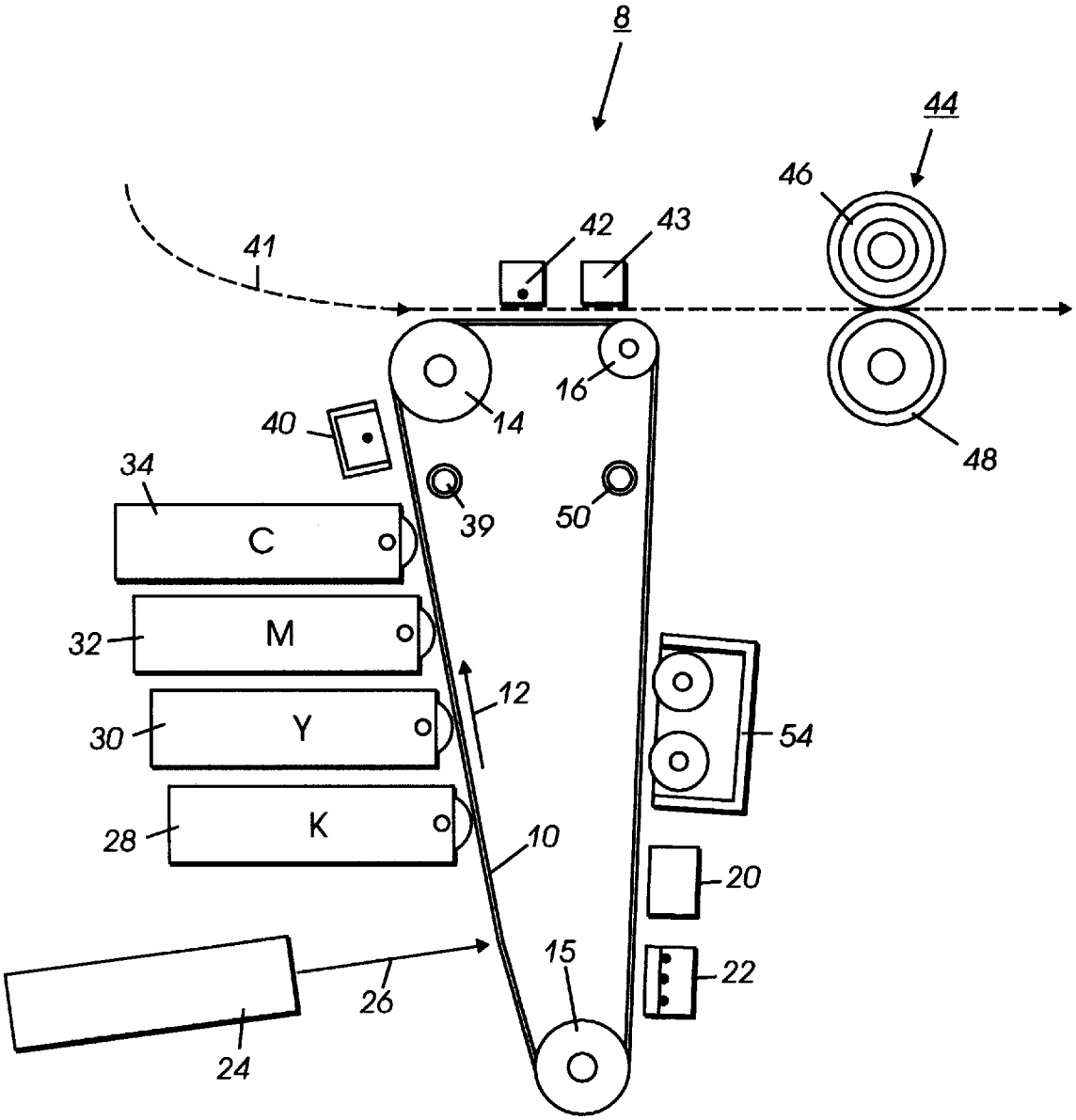
FIG. 1, which schematically depicts an electrophotographic printing machine that incorporates the principles of the present invention.

Referring now to FIG. 1, the preferred embodiment of the present invention is a Recharge-Expose-and-Develop Image on Image (REaD IOI) electrophotographic printing machine 8 in which a photoreceptor is sprayed with incorrect sign ions to reduce the potential of a charged photoreceptor and then the photoreceptor is recharged with correct sign ions between the development of one color toner layer and subsequent exposure for the next color toner. While the printing machine 8 includes a plurality of individual subsystems which are known in the prior art, those subsystems are organized and used in a new, useful, and unobvious way.

The printing machine 8 includes an Active Matrix (AMAT) photoreceptor belt 10 which moves in the direction indicated by the arrow 12. Belt movement is brought about by mounting the photoreceptor belt about a drive roller 14 (that is driven by a motor which is not shown) and tension rollers 15 and 16.

As the photoreceptor belt moves, each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas since each image area is processed in the same way a description of the processing of one image area suffices to fully explain the operation of the printing machine.

The production of a color document takes place in 4 cycles, or passes, of the image area through the machine. The first cycle begins with the image area passing through a charging station consisting of a first charging device 20 and a second charging device 22. During this first pass the image area is substantially uncharged (a result of an erase lamp 50 as is subsequently described). To charge the image area in preparation for exposure to create a latent image for a first image (black) the second charging device 22 charges the image area to a relatively high negative potential, say −500 volts. The actual charge will depend upon numerous factors such as the photoreceptor, the desired black toner mass, the settings of the black development station, the toner being used, and humidity. During this first pass the first charging station need not be used. It should be pointed out that the first and second charging stations can, at least in principle, be either AC or DC scorotron charging devices. In the example printing machine 8, the first charging device is a DC scorotron and the second charging device is an AC scorotron.

After passing through the charging station the image area advances until it reaches an exposure station 24. At the exposure station the charged image area is exposed to a modulated laser beam 26 that raster scans the image area such that an electrostatic latent representation of a black image is produced. For example, illuminated sections of the image area might be discharged by the beam 26 to about −50 volts. Thus after exposure the image area has a voltage profile comprised of relatively high voltage areas of about −500 volts and of relatively low voltage areas of about −50 volts.

After passing the exposure station 24 the exposed image area passes a black development station 28 which deposits negatively charged black toner particles onto the image area The charged black toner adheres to the illuminated areas of the image area thereby causing the voltage of the illuminated parts of the image area to be more negative than the latent image, but not as negative as the non-illuminated areas of the image area. For example the toned portions of the image area might have a potential of about −200 volts while the non-illuminated areas retain a potential of about −500 volts.

While the black development station 28 could be a magnetic brush developer, a scavengeless developer may be somewhat better. One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development stations (described below) use scavengeless development it may be better to use scavengeless development at each development station.

After passing the black development station the image area advances past a number of other stations, whose purposes are described subsequently, and returns to the charging station. The second cycle then begins.

During this cycle the first charging device 20 sprays the image area with positive ions. Those ions neutralize the charges on the image area and its toner layer. The result is a reduced potential. The image area then advances to the second charging device 22 which recharges the image area to the desired potential for subsequent exposure, again say −450 volts.

In this second pass, if either AC recharging or split recharging was used to recharge the image area, black toner particles would sometimes be pulled off of the photoreceptor and into the yellow developer during yellow development, thereby causing "Black in Yellow" contamination. One reason for this contamination is that the charge placed on the image area in preparation for the yellow image, while depending upon many variables, is usually less than the charge placed on the photoreceptor for the black image. Using either AC recharging or split recharging will result in the charge level on the photoreceptor being correct, but individual toner particles may have incorrect charges as a result of positive ions from the AC charger. Incorrectly charged black toner particles are attraction toward the negatively biased yellow developer causing "Black in Yellow" contamination. While DC only recharging would eliminate the positive ions, since the yellow photoreceptor potential is usually less than that of the unexposed areas of the image area a DC only recharge can not level the charge on the photoreceptor (which needs positive ions to neutralize the unexposed areas).

In the printing machine 8, positive ions are purposefully placed on the image area so as to reduce the potentials of both the toned and untoned portions of the image area to relatively low voltages. Then, a large amount of negative ions are sprayed onto the image area to increase the negative potential of both the toned and untoned portions of the image area to the desired voltage. The large number of negative ions effectively neutralize the positive ions, thereby reducing the possibility of cross-contamination.

Figure 2:
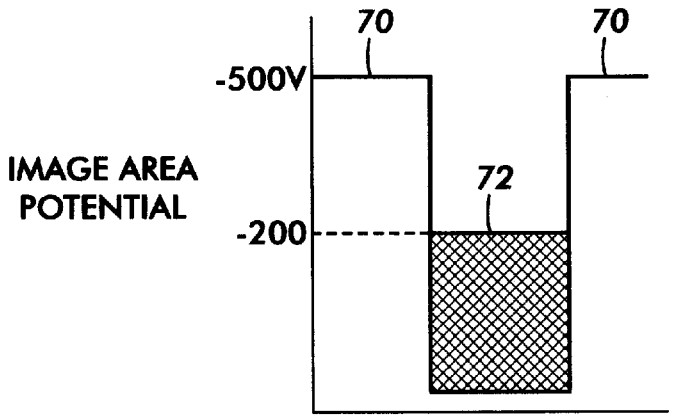
FIG. 2, which illustrates the image area potential after completion of the first pass of the image area.
Figure 3:
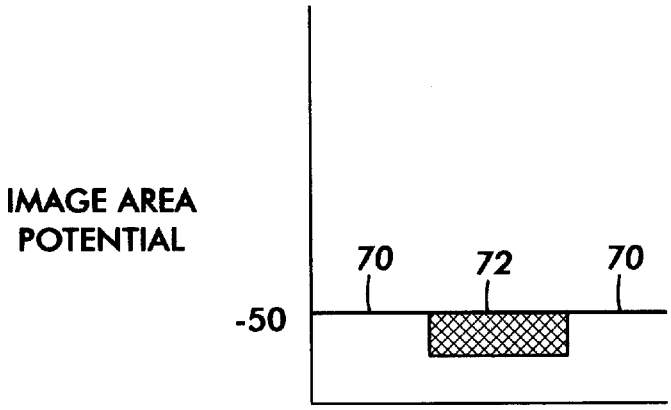
FIG. 3, which illustrates the image area potential after the image area of FIG. 2 passes the first charging device.
Figure 4:
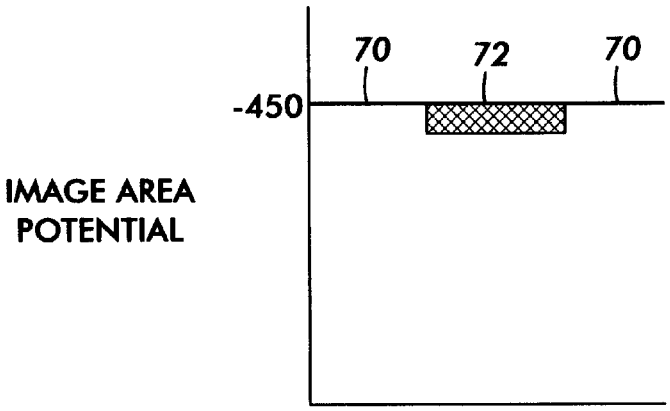
FIG. 4, which illustrates the image area potential after the image area of FIG. 3 passes the second charging device.

FIGS. 2–4 are useful in understanding the principles of the present invention. In FIGS. 2–4 the Y-axis represents image area potentials while the X-axis represents spatial locations. FIG. 2 represents the image area after the completion of the first pass. As shown, undeveloped portions 70 of the image area (and thus the unexposed portions) have a potential of about −500 volts while developed portions 72 have a potential of about −200 volts. FIG. 3 represents the image area after passing the first charging device 20. Positive ions supplied by the first charging station reduce the potentials of both the developed and undeveloped portions of the image area to a low potential, nominally say −50 volts. FIG. 4 represents the image area after passing the second charging device 22. Negative ions supplied by the second charging station overwhelm the positive ions and reduce the potentials of both the developed and undeveloped portions of the image area to a relatively large negative potential, nominally say −450 volts.

After recharging the image area with its black toner layer advances to the exposure station 24. The exposure station exposes the image area with the laser beam 26 so as to produce an electrostatic latent representation of a yellow image. As an example of the charges on the image area, the non-illuminated parts of the image area might have a potential about −450 volts while the illuminated areas are discharged to about −50 volts.

After passing the exposure station 24 the now exposed image area advances past a yellow development station 30 that deposits yellow toner onto the image area. Since the image area already has a black toner layer the yellow development station should use a scavengeless developer. After passing the yellow development station the image area and its two toner layers advance to the charging station. The third cycle then begins.

During the third cycle the first charging device 20 again sprays the image area with positive ions and the second charging device 22 again recharges the image area to the desired potential for subsequent exposure, again say −450 volts.

After recharging the image area with its black and yellow toner layers advance to the exposure station 24. The exposure station exposes the image area with the laser beam 26 so as to produce an electrostatic latent representation of a magenta image. As an example of the charges on the image area, the non-illuminated parts of the image area might have a potential about −450 volts while the illuminated areas are discharged to about −50 volts. The image area then advances through a magenta development station 32 that deposits magenta toner onto the image area. The result is a third toner layer on the image area. The image area with its three toner layers then advances yet again to the charging station. The fourth cycle then begins.

During the fourth cycle the first charging device 20 again sprays the image area with positive ions while the second charging device 22 again recharges the image area to the desired potential for subsequent exposure, again say −450 volts.

The substantially uniformly charged image area with its three toner layers then advances once again to the exposure station 24. The exposure station exposes the image area again, this time with a light representation that discharges some parts of the image area to create an electrostatic latent representation of a cyan image. After passing the exposure station the image area passes a cyan development station 34. The cyan development station deposits cyan toner onto the image area.

After passing the cyan development station the image area has four toner layers which together form a composite color image. That image is comprised of individual toner particles which have charge potentials which vary widely. Transferring such a composite toner image onto a substrate would result in a degraded final image. Therefore, it is beneficial to prepare the composite color image for transfer.

To do so a pretransfer erase lamp 39 discharges the image area to produce a relatively low potential on the photoreceptor. The image area then passes a pretransfer DC scorotron 40 that supplies sufficient negative ions to the image area that all positively charged toner particles are reversed in polarity.

The image area continues to advance in the direction 12 past the driven roller 14. A substrate 41 is then placed over the image area using a sheet feeder (which is not shown). As the image area and substrate continue their travel they pass a transfer corotron 42. That corotron applies positive ions onto back of the substrate 41. Those ions attract the toner particles onto the substrate.

As the substrate continues its travel is passes a detack corotron 43. That corotron neutralizes some of the charge on the substrate to assist separation of the substrate from the photoreceptor 10. As the lip of the substrate moves around the tension roller 16 the lip separates from the photoreceptor. The substrate is then directed into a fuser 44 where a heated fuser roller 46 and a pressure roller 48 create a nip through which the substrate 41 passes. The combination of pressure and heat at the nip causes the composite color toner image to fuse into the substrate. After fusing, a chute, not shown, guides the substrate to a catch tray, also not shown, for removal by an operator.

After the substrate is separated from the photoreceptor belt 10 the image area continues its travel and passes a preclean erase lamp 50. That lamp discharges most of the potential remaining on the photoreceptor belt. After passing the preclean erase lamp the residual toner and/or debris on the photoreceptor is removed at a cleaning station 54. At the cleaning station cleaning brushes wipe residual toner particles from the image area. This marks the end of the 4th cycle. The image area then passes to the charging station for the start of another 4 cycles.

Using well known technology the various machine functions described above are generally managed and regulated by a controller which provides electrical command signals for controlling the operations described above.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A color printing machine, comprising:

a photoreceptor having a first toner layer of a first color on part of an image area, wherein said first toner layer has a first potential, and wherein portions of said image area without said first toner layer have a second potential that is different than said first potential;

a first charging device for spraying said image area with ions that are predominately of a polarity that reduces the charges on said image area such that the potential of said first toner layer and said potential of said image area without said first toner layer are both reduced below a third potential;

a second charging device for charging said image area with ions that are predominately of a polarity which is opposite that sprayed on by said first charging device such that the potential of said first toner layer and of said image area without said first toner layer are increased to said third potential;

an exposure station for exposing said image area so as to produce a latent image on said photoreceptor; and a developing station for depositing charged toner on said latent image so as to form a second toner layer of a second color.

2. A color printing machine according to claim 1, wherein said first toner layer is black.

3. A color printing machine according to claim 2, wherein said second toner layer is yellow.

4. A color printing machine according to claim 1, wherein said first charging device is a DC scorotron.

5. A color printing machine according to claim 1, wherein said second charging device is an AC scorotron.

6. A color printing machine according to claim 1, wherein said first charging device charges said photoreceptor, said first toner layer, and said second toner layer to a common potential.

7. A color printing machine according to claim 1, further including:

a developing station for depositing charged toner of a third color on said image area so as to form a third toner layer;

a developing station for depositing charged toner of a fourth color on said image area;

a transfer station for transferring toner from said photoreceptor onto a substrate;

a cleaning station for removing residual toner and debris from said photoreceptor; and a fusing station for fusing transferred toner with said substrate.

* * * * *